US008707580B2

(12) United States Patent
Hopkins

(10) Patent No.: US 8,707,580 B2
(45) Date of Patent: Apr. 29, 2014

(54) DRYNESS DETECTION METHOD FOR CLOTHES DRYER BASED ON CHARGE RATE OF A CAPACITOR

(75) Inventor: Thomas L. Hopkins, Mundelein, IL (US)

(73) Assignee: STMicroelectronics, Inc., Coppell, TX (US)

( * ) Notice: Subject to any disclaimer, the term of this patent is extended or adjusted under 35 U.S.C. 154(b) by 1076 days.

(21) Appl. No.: 12/603,249

(22) Filed: Oct. 21, 2009

(65) Prior Publication Data

US 2011/0088279 A1 Apr. 21, 2011

(51) Int. Cl.
*F26B 13/10* (2006.01)

(52) U.S. Cl.
USPC ..... 34/527; 34/528; 34/531; 34/548; 34/550; 34/572; 8/159; 68/12.12; 68/20

(58) Field of Classification Search
USPC ..... 34/443, 80, 90, 524, 527, 528, 531, 34/548, 550, 572; 8/137, 159; 68/12.12, 68/12.16, 5 C, 20, 23 R
See application file for complete search history.

(56) References Cited

U.S. PATENT DOCUMENTS

| | | | | |
|---|---|---|---|---|
| 3,660,909 | A * | 5/1972 | Willcox | 34/533 |
| 4,657,039 | A * | 4/1987 | Bireley et al. | 137/78.3 |
| 4,683,904 | A * | 8/1987 | Iltis | 137/78.3 |
| 4,837,499 | A * | 6/1989 | Scherer, III | 324/696 |
| 4,896,795 | A * | 1/1990 | Ediger et al. | 222/63 |
| 4,952,868 | A * | 8/1990 | Scherer, III | 324/664 |

FOREIGN PATENT DOCUMENTS

DE 4030284 A1 * 6/1992

* cited by examiner

*Primary Examiner* — Steve M Gravini
(74) *Attorney, Agent, or Firm* — Seed IP Law Group PLLC

(57) ABSTRACT

A dryer having an improved automatic dryness detection circuit is provided. Wet clothing in the dryer bin contacts a sensor and causes a pulse to be sent to a microcontroller if the resistance of the clothes is low enough. The microcontroller disregards pulses which are shorter than a threshold time and counts pulses which are longer than a threshold time. The microcontroller issues a termination signal if the rate of pulses is lower than a threshold rate.

7 Claims, 8 Drawing Sheets

DRYNESS DETECTION METHOD FOR CLOTHES DRYER BASED ON CHARGE RATE OF A CAPACITOR

TECHNICAL FIELD

The present disclosure relates to a method and a circuit for detecting the moisture content of articles in an automatic dryer.

DESCRIPTION OF THE RELATED ART

Many clothes dryers allow the user to select a specific amount of time for the clothes dryer to dry a load of laundry. This selection can be made using a dial or a digital interface on the outside of the dryer.

Many dryers alternatively allow the user to select a level of dryness to which the dryer will dry a load of laundry. In this type of dryer there is typically some kind of mechanism for monitoring how dry the laundry is. When the dryer detects that the load of laundry has reached the level of dryness selected by the user, then the drying cycle ends.

In one system the humidity of the air exiting the dryer is monitored. As the dryer dries the clothes, water in the clothes evaporates and is expelled through the dryer vent. At first the air in the dryer is quite humid. But as the clothes become drier, the humidity in the air passing through the vent decreases. In such a system the dryer assumes that the clothes are dry once the humidity of the air passing through the vent has dropped below a threshold value. The dryer then turns off.

A challenge faced by automatic dryers is to ensure that the clothes do not stay in the dryer too long. This is countered by the need to ensure that the clothes are sufficiently dry. Over-drying clothes can damage certain types of delicate clothing and waste energy. A dryer that frequently continues to operate after the clothes are dry may also shorten its own lifetime.

BRIEF SUMMARY

In one embodiment, two conductors are positioned in the drying bin of a clothes dryer. The clothes dryer comprises a bin for drying the clothes and a sensor in the dryer bin. A capacitor is coupled to the sensor and configured to charge when the clothes are in contact with the sensor. A microcontroller is coupled to the capacitor and is configured to measure a charge time of the capacitor. The microcontroller is configured to output a termination signal to end the drying cycle based on the charge time. The charge time of the capacitor is proportional to the resistance of the clothing in contact with the sensor.

In one embodiment the sensor is two conducting bars in the dryer bin. When an item of clothing is in contact with both of the conducting bars, the item of clothing acts as a conductor having a resistance connected between the conducting bars and the capacitor is enabled to charge. If the resistance of the clothing is low enough, the capacitor will charge to a threshold voltage. A switch is coupled to the capacitor and configured to turn on when the capacitor reaches the threshold voltage.

In one embodiment, a microcontroller enables a discharge transistor to discharge the capacitor at the instance the switch turns on. The capacitor will then recharge and the microcontroller measures the time for the capacitor to recharge and enable the switch again. The microcontroller monitors the moisture content of clothes based on the charging rate of the capacitor in the RC circuit. Since the value of R in the RC circuit varies depending on how dry the clothes are, the capacitor charge time is a good indication of the moisture content of the clothes. The charge time is measured over a plurality of charge times. The microcontroller may issue a termination signal to end the drying cycle based on the one or more of the charge times.

One embodiment of a method for drying clothes in a clothes dryer comprises charging a capacitor when clothing in the dryer bin contacts a sensor in the dryer bin, measuring the charge time of the capacitor to reach a threshold voltage, and terminating the drying cycle based on the charge time.

In one embodiment the method further comprises discharging the capacitor once the capacitor reaches the threshold voltage and measuring a time to recharge the capacitor to the threshold voltage.

DETAILED DESCRIPTION

Figure 1:
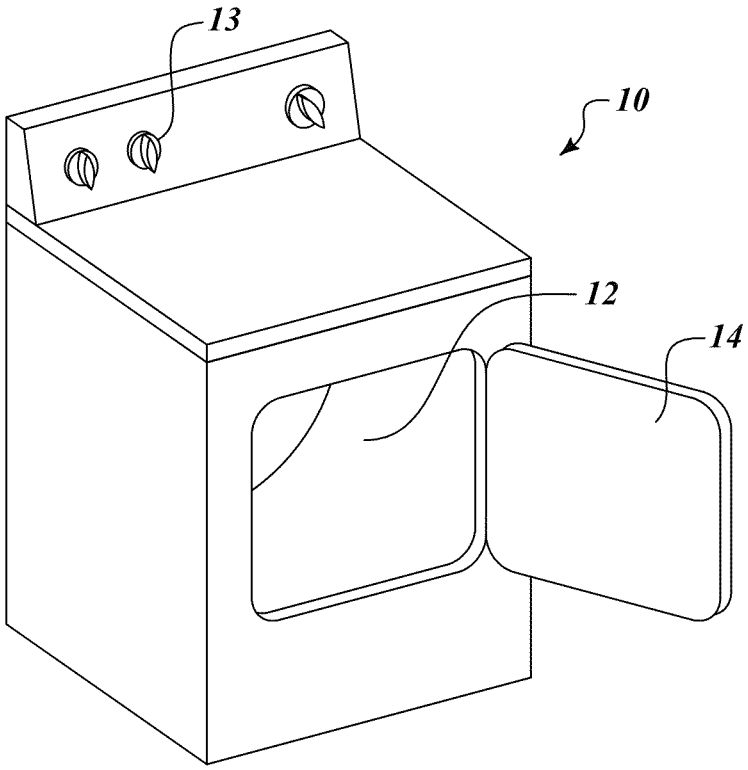
FIG. 1 is a side elevational view of a dryer with the door open exposing the dryer bin.

FIG. 1 illustrates a dryer 10. The dryer 10 has a dryer bin 12 in which a user places wet clothing or other articles to be dried. The dryer 10 has a door 14 which opens to enable access to the dryer bin 12. The dryer 10 has a panel which has a user input 13.

The user can use the user input 13 to select an automatic drying cycle and a desired level of dryness for the automatic drying cycle. The dryer 10 is configured to end the automatic drying cycle when clothes placed in the bin 12 have reached the level of dryness specified by the user.

Figure 2:
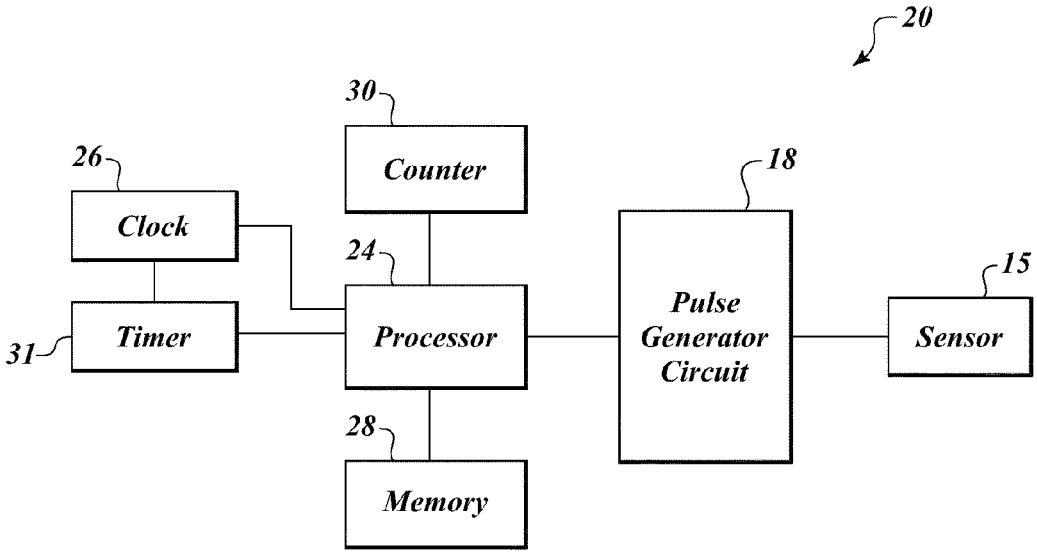
FIG. 2 is a block diagram of a moisture detection circuit according to one embodiment.

FIG. 2 illustrates a dryness moisture detection circuit 20 according to one embodiment of the invention. A sensor 15 is located in the dryer bin 12. The sensor 15 is configured to detect a moisture content of clothing or other articles placed in the dryer bin 12 or to enable detection of a moisture content of articles in the dryer bin.

The sensor 15 is coupled to a pulse generator circuit 18. When wet clothes contact the sensor 15, the pulse generator circuit 18 outputs a pulse to a processor 24. The processor 24 is coupled to a clock 26, a memory 28, a counter 30, and a timer 31. The memory 28 stores and retrieves data. The data includes information regarding pulses received from the pulse generator, software to enable execution of programs by the processor 24, or any other data which may be used by the processor 24 or other components.

The counter 30 counts a number of pulses received by the processor 24 from the pulse generator circuit 18. The timer 31 may be used to measure a time required for the pulse generator circuit 18 to change from a first state to a second state.

In one embodiment, the processor 24 monitors a time required for the pulse generator circuit 18 to change from a first state to a second state. If the time required to change from the first state to the second state is longer than a threshold time, then the processor 24 issues a termination signal to end the drying cycle. The memory 28 may store data regarding a plurality of pulses and the processor may issue the termination signal based on times from a plurality of pulses. Other embodiments may have fewer or more components than those shown in FIG. 2. Also, the components may be connected differently to each other without departing from the scope of the present disclosure.

Figure 3:
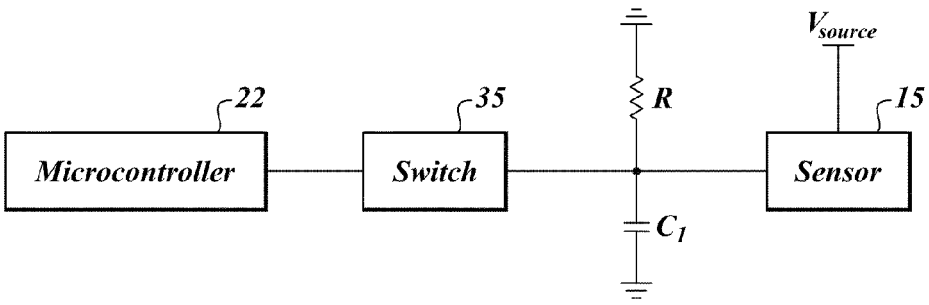
FIG. 3 is a block diagram of a moisture detection circuit according to one embodiment.

FIG. 3 illustrates an alternative embodiment of the invention. The sensor 15 is coupled to a voltage source Vsource, a capacitor $C_1$, a resistor R, and a switch 35. When articles or clothing in the dryer bin 12 contact the sensor 15 the capacitor $C_1$ begins to charge. The capacitor $C_1$ will charge to a voltage at a rate dependent on a moisture content of the clothing. If the moisture content is high enough, then the capacitor $C_1$ will charge quickly beyond a threshold voltage of the switch 35 and activate the switch 35. The switch 35 causes a pulse to be output to a microcontroller 22 when the voltage on the capacitor $C_1$ charges beyond the threshold voltage of the switch 35. The resistance of the clothes is a variable value in an RC circuit. Since the value of the capacitor $C_1$ does not change, the time constant will vary based on the changes in the resistance R.

The value of the bleed resistor R is selected to permit the capacitor to charge under normal operating conditions. The value R is usually a high resistance, such as in the mega ohm range; after the clothes are no longer in contact with the sensor, the capacitor will discharge through R to be ready for the next sensing event.

If the resistance of the clothes is low, then enough voltage is dropped across the resistor R to permit the capacitor to charge to the threshold voltage rapidly; if the resistance of the clothes is high enough, then enough voltage will be dropped across the clothes to prevent the capacitor from charging to the threshold voltage and the switch will not be activated.

In one embodiment the microcontroller 22 may include the processor 24, the clock 26, the memory 28, the counter 30, and the timer 31. The microcontroller 22 receives pulses from the switch 35. Counter 30 counts the pulses. The processor 24 monitors the counter 30 to determine if the number of counted pulses in a selected time period is smaller than a threshold number. If the number of counted pulses is less than a threshold number then the processor 24 issues a termination signal to end the drying cycle.

In one embodiment the microcontroller 22 is configured to measure a charge time of the capacitor $C_1$. The charge of the capacitor $C_1$ is indicative of a relative moisture content of the clothing or articles in the dryer bin. If the charge time is longer than a threshold time, then the microcontroller 22 issues a termination signal. In one alternative, the microcontroller 22 records in the memory 28 a plurality of charge times. The microcontroller may retrieve data regarding charge times of the capacitor $C_1$ from the memory 28 and determine whether the clothes are dry based on data from a plurality of charge times.

Figure 4:
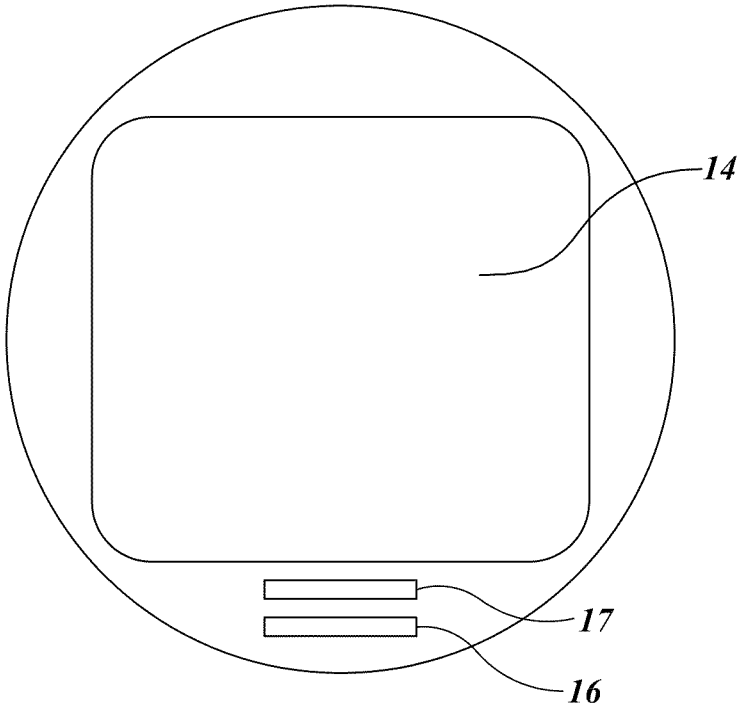
FIG. 4 is a view from the inside of the dryer bin showing two conducting bars situated in the dryer bin below the door of the dryer according to one embodiment.

FIG. 4 illustrates a view of the inside of the dryer bin 12 from the inside of the dryer bin 12. In one embodiment, the sensor 15 is two conducting bars 16 and 17 positioned below the door 14. In one embodiment the conducting bars 16 and 17 are between eight and ten inches in length. In one embodiment the conducting bars 16 and 17 are spaced apart by about an inch. In another embodiment, the bars 16 and 17 are 2-3 inches long and ⅛ inch apart. The conducting bars 16 and 17 are electrically insulated from each other when the dryer bin 12 is empty. The conductors 16 and 17 may of course be other shapes than bars and may be other sizes and spaced differently than described above.

Prior to the beginning of a drying cycle, wet clothes or other articles are loaded into the bin 12 of the dryer 10. The user then selects an automatic drying cycle at the user selection 13 and begins the drying cycle. During the drying cycle the bin 12 rotates, which tumbles the clothes. The clothes are thus moved about throughout the bin 12. As the clothes tumble, individual items of clothing randomly and momentarily come into contact with both conducting bars 16 and 17 below the door 14. If an item of clothing contacts both conducting bars 16 and 17 simultaneously, then the clothing momentarily acts as a conductor connected between the two conducting bars 16 and 17. Of course, two items of clothing that are in contact with each other, while each is in contact with respective conductive bars, will also act as a resistive electrical conductor between the conducting bars 16 and 17.

Wet clothing generally has a lower resistance than dry clothing. When wet clothing contacts the conductive bars 16 and 17 there is a lower resistance between the conducting bars 16 and 17 than if dry clothing contacts the conductive bars 16 and 17. This configuration can be utilized to sense a relative moisture content (RMC) of the clothing. When the RMC of the clothing drops below a threshold level, according to the automatic drying cycle selected, the dryer 10 automatically shuts off.

Figure 5:
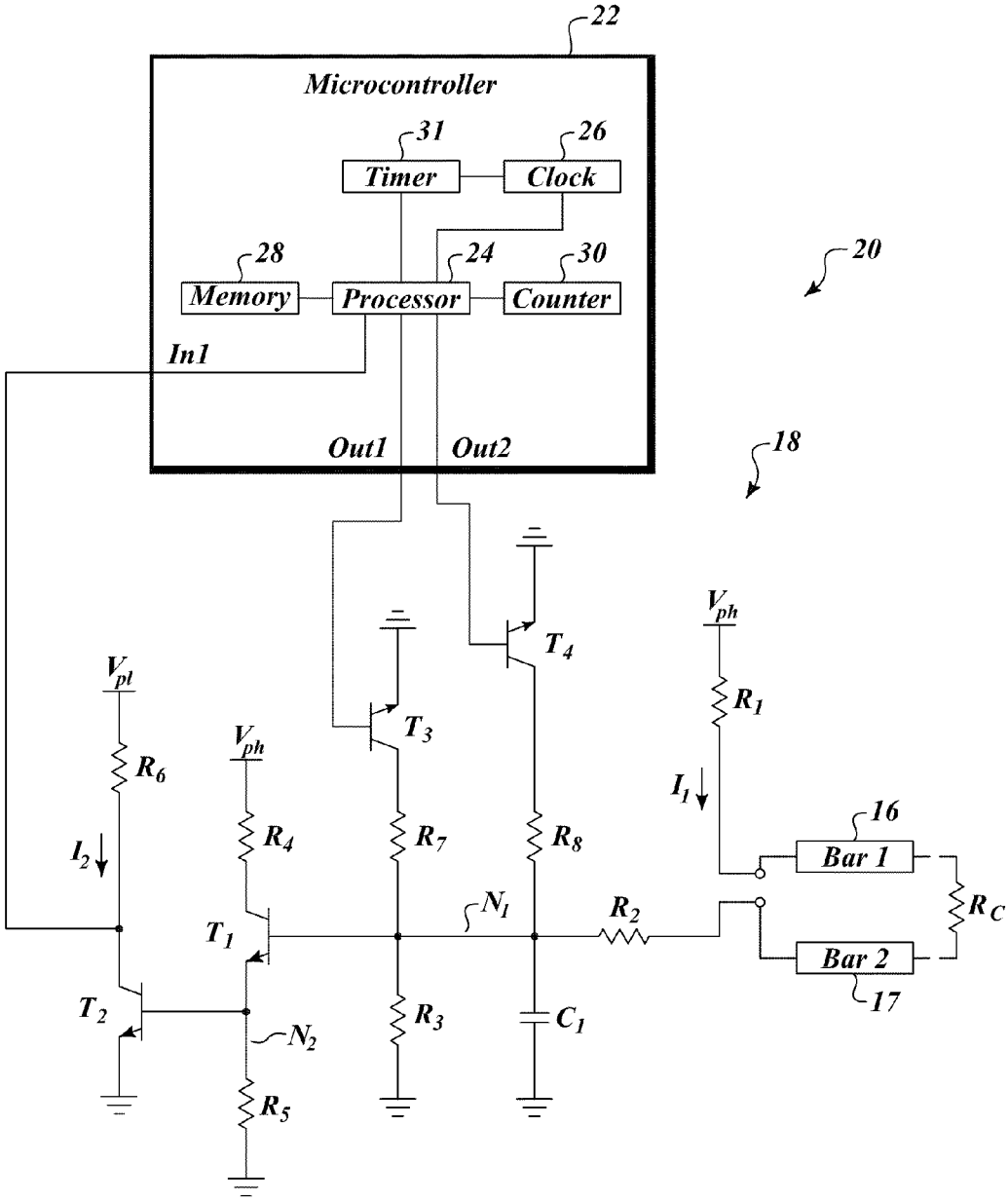
FIG. 5 is a schematic diagram of a moisture detection circuit according to one embodiment.

FIG. 5 illustrates a moisture detection device 20 according to one embodiment of the present invention. A pulse generator circuit 18 is coupled to the conductive bars 16 and 17. The pulse generator circuit 18 typically is not located in the dryer bin, but may be located in any suitable portion of the dryer that protects the circuit from being damaged.

A resistor $R_1$, for example 4 kΩ, is connected between a high positive voltage supply Vph, for example 17V, and the first conductive bar. The second conductive bar is not usually electrically connected to the first conductive bar as shown in the situation illustrated in FIG. 4. When clothing comes in contact with the two bars 16 and 17 at the same time, an electrical path denoted Rc, for clothing resistance, is provided between the bars. The value of Rc varies greatly from low, under 4 kΩ, to quite high, over 5 MΩ, to 10 MΩ, depending on the amount of moisture in the clothes.

A resistor $R_2$, for example 4 kΩ, is coupled between the second conductive bar and node $N_1$. A capacitor $C_1$, for example 3.3 nF, is coupled between node $N_1$ and ground. A resistor $R_3$, for example 5 MΩ, is coupled between $N_1$ and ground. The base of transistor $T_1$ is coupled to $N_1$. Resistor $R_4$, for example 750 kΩ, is coupled between the high positive voltage supply and the collector of $T_1$. The emitter of $T_1$ is coupled to node $N_2$. A resistor $R_5$, for example 68 kΩ, is coupled between $N_2$ and ground. The base of transistor $T_2$ is also coupled to $N_2$. The emitter of $T_2$ is coupled to ground. The collector of $T_2$ is coupled to an input In1 of microcontroller 22. Resistor $R_6$, for example 100 kΩ, is coupled between a low positive voltage supply Vp1, 5V for example, and In1. The bases of transistors $T_3$ and $T_4$ are connected to Out1 and Out2, respectively, of the microcontroller 22. The emitters of $T_3$ and $T_4$ are connected to ground. The collectors of $T_3$ and $T_4$ are connected to node $N_1$ then resistors $R_7$ and $R_8$ respectively. $R_7$ is for example 18 kΩ. $R_8$ is for example 510Ω. The specific values and configuration of circuit components are given merely by way of example and are not limiting. The circuit components may be arranged in many other configurations and have many other values according to other embodiments of the invention. In particular, transistors $T_1$, $T_2$, $T_3$ and $T_4$ may be implemented as MOS transistors or any other suitable transistor according to other embodiments of the pulse generator circuit 18. Transistors T1 and T2 may also be replaced by a comparator circuit with a threshold set by a resistor divider network.

Operation of the circuit of FIG. 5 will now be described. When clothes placed in the bin 12 undergo a drying cycle, they periodically come into contact with the conductive bars 16 and 17. An item of clothing in contact with both bars 16 and 17 acts as a conductor having the resistance value Rc connected between the bars 16 and 17. This conduction allows an electric current I1 to flow between the two bars 16 and 17 at a value related to the resistance of the clothes, Rc. I1 flows from the high positive voltage source Vph through $R_1$, through Rc (the clothes), and $R_2$. I1 causes the capacitor $C_1$ to charge. If transistors $T_1$, $T_3$, and $T_4$ are off, then I1 will reach the following steady state current:

$$I1 = \frac{Vph}{R_1 + Rc + R_2 + R_3}$$

where Rc is the resistance of the clothing between the bars 16 and 17.

The current I1 will charge the capacitor to a voltage Vc dependent on the resistance of the clothes Rc according to the following relationship:

$$Vc = I1 \cdot R_3 = \frac{Vph \cdot R_3}{R_1 + Rc + R_2 + R_3}$$

If the voltage Vc on the capacitor $C_1$ is greater than the base-emitter turn on voltage, Vbe1, of transistor $T_1$, then $T_1$ will turn on. If the voltage Vc on the capacitor $C_1$ is greater than Vbe1 plus the base-emitter turn on voltage, Vbe2, of transistor $T_2$, then $T_2$ will turn on as well and the voltage at the base of $T_1$ will be clamped to the sum of Vbe1 plus Vbe2. When $T_2$ is turned on, current I2 flows from the low positive voltage source through resistor $R_6$. This causes the voltage to drop at In1. This drop in voltage acts as a pulse at In1. The microcontroller 22 receives the pulses at In1.

In order for a pulse to be sent to the microcontroller 22, the voltage Vc on the node $N_1$, on one plate of capacitor $C_1$ must be equal to or greater than a threshold voltage Vt:

$$Vt = Vbe1 + Vbe2$$

The rate at which the capacitor $C_1$ charges is based on the RC time constant of the circuit. For the circuit of FIG. 5, the RC circuit includes components $R_1$, Rc, $R_2$, $R_3$ and $C_1$. Until transistor $T_1$ turns on, any current flow through it is so low it can be considered zero; therefore the amount of time for $C_1$ to reach the threshold voltage to enable $T_1$ will vary in direct proportion to the resistance of the clothes, which varies in proportion to their moisture content.

The voltage to which the capacitor $C_1$ may charge also depends in part on the resistance Rc of the clothing in contact with the bars 16 and 17. Thus, if the resistance Rc of clothing which has contacted the bars 16 and 17 is below a threshold resistance, the voltage on node $N_1$ will exceed Vt, but if the resistance is high, it will not reach Vt.

The duration of a pulse corresponds to the length of time that the wet clothing contacts the bars 16 and 17. Once a pulse has been generated, the pulse will continue as long as the wet clothing remains in contact with the bars. Once the clothing is no longer in contact with the bars 16 and 17, the capacitor $C_1$ discharges through the resistor $R_3$ to ground. The discharge of the capacitor $C_1$ causes the voltage Vc of the capacitor $C_1$ to drop. Once the voltage Vc at $N_1$ has dropped below the threshold voltage Vt, the transistor $T_2$ turns off and current I2 no longer flows. When current I2 no longer flows, the voltage at In1 increases to the level of the power supply Vp1. The return of the voltage at In1 to Vp1 denotes the end or trailing edge of the pulse.

The microcontroller 22 comprises a processor 24, a clock 26, a system memory 28, a counter 30, a timer 31, and a filter 33 as shown in FIG. 2. The clock 26 may be a crystal oscillator, a resonant circuit, an RC circuit, or any other means suitable for generating a clock signal. The system memory 28 is coupled to processor 24 and is configured to store and retrieve data. The memory 28 may store program data for the operation of the microcontroller 22, data regarding pulse counts and pulse lengths, or any other data. The memory 28 may include one or more arrays of ROM, EPROM, EEPROM, Flash memory, SRAM, DRAM or any other suitable memory. The counter 31 is either a register in the processor 24 or is coupled to the processor 24 and serves to count pulses received from the pulse generator circuit 18 at input In1. In practice, the microcontroller 22 may have many more or different components and the components may be connected differently than is shown in FIG. 5.

When the pulse generator circuit 18 generates a pulse at the input In1, the processor 24 detects the pulse and causes the counter 30 to increment. The counter 30 thus counts the number of pulses generated by the pulse generator circuit 18.

In one embodiment, the processor 24 monitors the number of pulses generated during each of a plurality of defined counting periods. At the end of each counting period the processor 24 monitors the counter 30 to determine the number of pulses received during the counting period. The number of pulses received during the counting period defines a rate at which pulses are being received. At the end of the counting period, a new counting period begins and the rate of pulses is monitored again for the new counting period. In one embodiment, each counting period is about two seconds.

The rate at which pulses are being received corresponds to the RMC of the clothing in the dryer bin 12. If the clothes are wetter, then the pulses will be generated more frequently. If the rate at which pulses are received drops below a threshold pulse rate for a number of counting periods, then the processor 24 determines that the clothes are dry and issues a shutdown signal which terminates a drying cycle of the clothes dryer 10. In one embodiment the processor 24 issues the shutdown signal if the rate of pulses drops below the threshold rate for two consecutive counting periods. Of course, in other embodiments the processor 24 may issue the shutdown signal after more or fewer counting periods than two.

Under some circumstances, the rate of pulses may falsely indicate that the clothing is wet when the clothing is in fact dry. These errors may arise due to static discharge of the clothing in the dryer bin 12 or noise from other sources. These last two very short pulses 40 and 41 are so short that they are considered to be due to static discharge from the clothing or local noise in the system.

A dryer circuit is in an electrically noisy environment and noise may be generated in the sensing circuit from a number of locations, such as from the 60 Hz power line, spiking in the power supplies, the switching control signals, the power for driving the motor that is rotating the drum, the electrical control panel, or even from such sources as the filter mesh, a person banging the lid, or other unexpected locations. It is therefore desired to prevent noise from various sources having an impact on the sensing of clothing moisture content.

As the clothing becomes drier, certain types of fabric tend to frequently build up a static charge. When an item of clothing that has a build up of static charge contacts the second conductive bar, the static charge discharges through the second conductive bar. This static discharge quickly charges the capacitor $C_1$ beyond the threshold Vt and a pulse is generated as previously described. Thus as the clothes become drier, many pulses may be sent to the microcontroller 22 due to static discharge. These pulses increment the counter 30 and the microcontroller 22 may interpret the rate of pulses to mean that the clothing is wet. The pulses due to static discharge may cause the dryer 10 to continue drying after the clothes are already dry. The prolonged drying cycle needlessly wastes energy. The clothing may also be damaged if it remains in the dryer 10 longer than necessary.

The pulses generated due to static discharge are generally very short compared to the pulses generated due to contact of wet clothing with the conductive bars 16 and 17. The reason for this is that static charge discharges very rapidly. A static discharge will quickly charge the capacitor $C_1$ and then cease delivering current. When current is no longer supplied, capacitor $C_1$ discharges through the resistor $R_3$. Pulses generated due to static discharge are thus much shorter than those due to wet clothing.

Figures 6A, 6B:
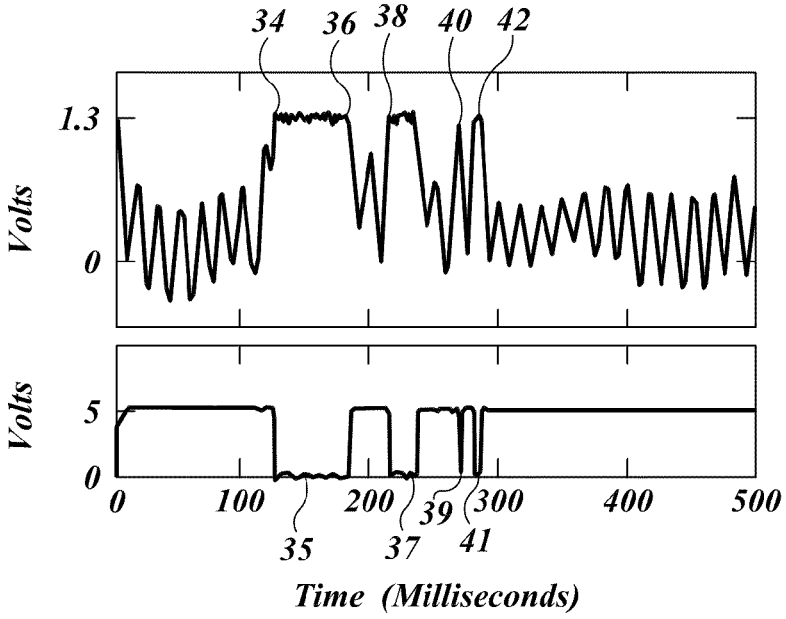
FIG. 6A is a graph illustrating the voltage on a capacitor during a drying cycle of a clothes dryer according to one embodiment.
FIG. 6B is a graph illustrating the voltage of an input to a microcontroller according to one embodiment.

FIGS. 6A and 6B are sample graphs of the voltage on the capacitor $C_1$ and the voltage on the input In1 respectively during a portion of a drying cycle. FIG. 6A shows the voltage on the capacitor $C_1$ during a 500 millisecond sample of an end portion of a drying cycle. FIG. 6B illustrates the voltage at the microcontroller input In1.

In FIG. 6A at 34, the capacitor reaches the threshold voltage of about 1.3V. At this time, the voltage at In1 (illustrated in FIG. 6B) drops from 5 volts to about 0 volts. This drop from 5 volts to 0 volts constitutes the leading edge of pulse 35. In FIG. 6A at 36, the voltage on the capacitor drops below the threshold voltage. At this time the voltage at In1 of FIG. 6B returns to 5V. This constitutes the trailing edge or end of the pulse 35. The pulse 35 lasts about 50 milliseconds In FIG. 6B, pulse 37 begins when the voltage on the capacitor in 6A reaches the threshold voltage at 38. Two very brief pulses, 39 and 41 occur when the voltage on the capacitor briefly reaches the threshold at 40 and 42 respectively. These last two very small pulses are considered to be due to noise, such as static discharge from the clothing. In the example illustrated in FIGS. 6A and 6B, pulses 39 and 41 are comparatively brief and can be identified as spurious pulses due to static electricity.

In one embodiment, the microprocessor 22 measures the charge time of the capacitor $C_1$. The time required for the capacitor $C_1$ to charge from ground to the threshold voltage is approximately proportional to the resistance Rc of the clothing. If Rc is higher, then a smaller current will flow through the conducting bars 16 to charge the capacitor $C_1$. If Rc is lower, then a larger current will through the conducting bars 16 to charge the capacitor $C_1$. A larger current will charge the capacitor more quickly. Thus the charge time of the capacitor gives an indication of the resistance Rc of the clothing. The rise time of the voltage Vc on node $N_1$ therefore gives an indication of the moisture content of the clothes. The resistance Rc of the clothing gives an indication of the moisture content of the clothing.

The microcontroller 22 receives a pulse when the capacitor $C_1$ has charged to the threshold voltage, but charge rate needs to be measured. The times at which the clothing contacts both conductors 16 to begin charging the capacitor $C_1$ are somewhat random. The problem of monitoring or deducing when the capacitor $C_1$ begins to charge can be overcome in many ways.

In one embodiment, the microprocessor 22 outputs a high voltage at Out1 when a leading edge of a pulse is received at In1. The high voltage turns on $T_3$ which rapidly discharges the capacitor $C_1$. This happens very quickly, on the order of microseconds or nanoseconds. The time to discharge the capacitor is $C_1$ is very small compared to the typical duration for which an article of clothing remains in contact with the conducting bars 16. When the capacitor falls below the threshold voltage, In1 returns to the positive voltage and the pulse ends.

During and after discharge of the capacitor $C_1$ by $T_3$, the clothing is usually still in contact with the conducting bars 16 and 17. At the next stage, microprocessor 22 brings Out1 low and $T_3$ turns off. If the clothing is still in contact with the bars 16 and 17, the capacitor $C_1$ immediately begins to recharge. When the capacitor $C_1$ recharges to the threshold voltage, a pulse is again generated at In1. The microprocessor 22 measures the time from Out1 going low (end of forced discharge) to In1 going low again (new pulse received) and uses this to determine the charge time for the capacitor $C_1$. Since the discharge of capacitor $C_1$ happened quickly, if the cause of signal In1 going low was clothes, the clothing will still be in contact with the bars 16 and 17, on the other hand, if the cause of In1 going low was noise, the effects are likely gone and the voltage will not begin to climb again on node $N_1$.

Alternatively, the microcontroller 22 can measure the charge time from the time that Out1 is brought high (beginning of forced discharge) to the time that In1 goes low. In this scenario, the microcontroller 22 can adjust the charge time to take into account the known period for which Out1 was high. In either way, the charge time of the capacitor $C_1$ can be accurately measured and the RMC can be calculated. As the clothes become dryer, the charge time is longer. Based on the charge time of the capacitor, the microcontroller 22 can issue a termination signal to terminate a drying cycle.

In one embodiment, microcontroller 22 stores data from a plurality of measured charge times in the memory 28. The microcontroller 22 can monitor the plurality of charge times and calculate a relative moisture content of the clothing based on the plurality of charge times. The microcontroller 22 may then issue the termination signal based on data accumulated the plurality of charge times.

Figures 7A, 7B, 7C:
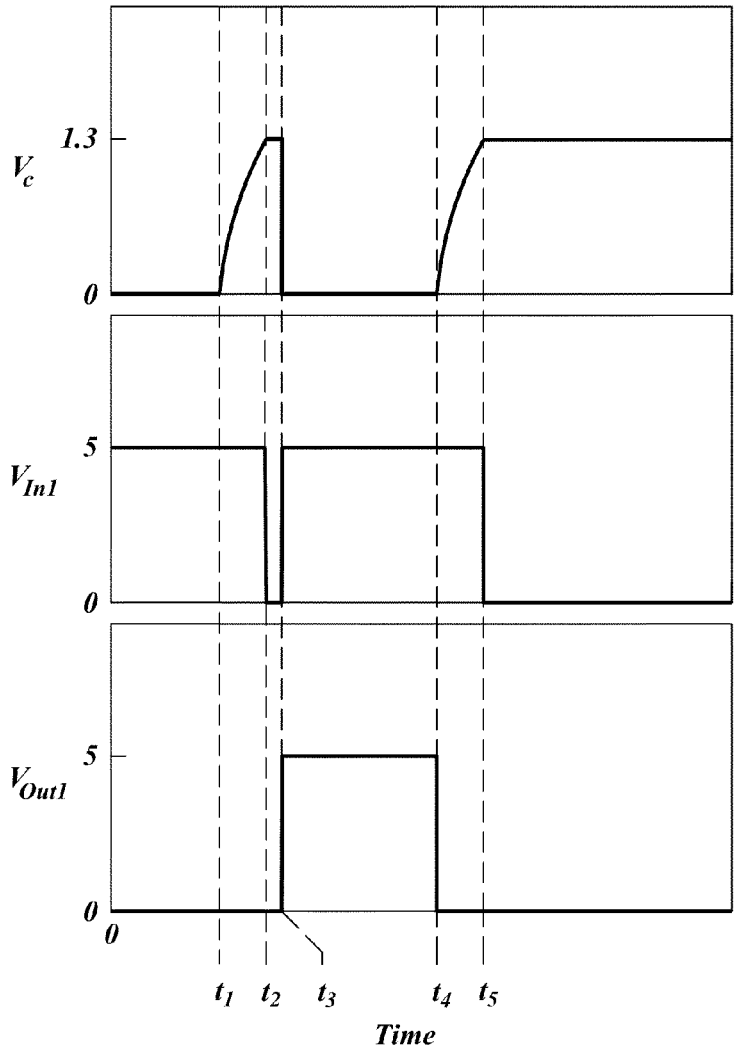
FIG. 7A is a graph of voltage on the capacitor.
FIG. 7B is a graph of the voltage on an input of a microcontroller during a same time frame as the graph of FIG. 7A.
FIG. 7C is a graph of the voltage on an output of the microcontroller during a same time frame as the graph of FIGS. 7A and 7B.

FIGS. 7A, 7B, and 7C provide graphs of the voltages on the capacitor $C_1$, the microcontroller input In1, and the microcontroller output Out1, respectively, in a process for measuring the charge time of the capacitor $C_1$. At time $t_1$ clothing comes into contact with the conducting bars 16 and the capacitor $C_1$ begins to charge. At time $t_2$ the capacitor $C_1$ has charged to the threshold voltage Vc. At this time, transistors $T_1$ and $T_2$ turn on, causing the voltage on In1 to drop toward ground. This drop in voltage signifies the leading edge of a pulse. When the microcontroller 22 detects this pulse, the microcontroller 22 brings Out1 high at $t_3$. In one embodiment, the difference between $t_2$ and $t_3$ is about 0.1 ms (milliseconds). When Out1 goes high, transistor $T_3$ turns on and rapidly discharges the capacitor $C_1$ causing the voltage Vc on the capacitor $C_1$ to go to 0V. The rapid discharge is enabled when $R_7$ is a low value. The rate of discharge can be varied by changing the value of $R_7$, as discussed later herein. When the capacitor falls below the threshold voltage, the low going pulse on In1 ends and the voltage on In1 returns high. Out1 remains high until time $t_4$, for example about 1.0 ms after $t_3$. While Out1 remains high, the capacitor $C_1$ is prevented from charging. When the processor brings Out1 low at $t_4$, the capacitor $C_1$ immediately begins to charge again if the clothes are still in contact with conducting bars 16. At time $t_5$ the capacitor $C_1$ has charged to the threshold voltage of V and In1 is brought low, signifying the leading edge of another pulse. Microcontroller 22 measures the charge time of the capacitor as the time from $t_4$ to $t_5$ that the capacitor recharges to the threshold voltage, about 0.3 ms (milliseconds) in this example. Alternatively, the microcontroller 22 can measure the charge time as the time from Out1 going high at $t_3$ to the time that In1 again goes low at $t_5$ and then subtract the known time for which Out1 was high (about 1 ms). From this data, a resistance of the clothing can be calculated. From the resistance of the clothing, the moisture content of the clothing can be calculated. The moisture content of the clothing is usually calculated as the relative moisture content (RMC) numbered value.

The microcontroller 22 can issue the termination signal if the charge time is greater than a threshold charge time. Alternatively the microcontroller 22 can assemble a database of charge times and issue the termination signal based on a plurality of charge times. Of course there are many other schemes available for measuring the charge time and issuing the termination signal as are apparent in light of the current disclosure. All such schemes fall under the scope of the present disclosure.

One embodiment is a dryer 10, comprising: a bin 12 for drying clothes; a moisture sensor 15 in the bin 12; a capacitor C1 coupled to the moisture sensor 15 and configured to charge when the clothes contact the sensor 15; a first switch T2 coupled to the capacitor C1 and configured to generate a pulse when a voltage of the capacitor C1 reaches a threshold voltage; and a microcontroller 22 coupled to the first switch T2 and configured to receive the pulse, to calculate a charge time of the capacitor C1, and to output a termination signal when the charge time exceeds a threshold value. In one embodiment the dryer 10 comprises a second switch T3 coupled to the capacitor C1 and configured to discharge the capacitor C1 on a leading edge of the pulse.

The embodiment for measuring charge time, described in relation to FIGS. 7A-7C, is very effective because of the time during which $T_3$ discharges the capacitor $C_1$ can be easily controlled. In one embodiment $R_7$ has a low value and Out1 is brought high to enable $T_3$ to discharge the capacitor within 1 ms or less after an initial pulse is received due to clothing contacting the conducting bars 16 and 17. Clothing that contacts the conductors 16 and 17 typically remains in contact for at least several tens of milliseconds. Thus after the 1 ms forced discharge period ends, the clothing is almost certainly still in contact with the conductors 16 and 17. This means that the capacitor immediately begins recharging once the discharge transistor $T_3$ is disabled, because the clothes are still in contact with the conductors 16 and 17. The rise time of the voltage Vc on node $N_1$ therefore gives an indication of the moisture content of the clothes. Thus calculating the charge time as the time period from the end of the forced discharge (bringing Out1 low to disable $T_3$) to the time that In1 receives another pulse gives an accurate measurement of the charge time of the capacitor $C_1$.

In a first embodiment, the value of $R_7$ is low, less than 10 kΩ, and the capacitor $C_1$ discharges quickly. The signal Out1 is kept high for a threshold period of time selected to mask out noise. If a noise pulse of 10 ms is to be blocked, then Out1 remains high for about 10 ms, after which it goes low and permits the capacitor $C_1$ to begin to charge. If the noise pulse is gone, then the rise time for the voltage at $N_1$ will be based on the moisture content of the clothing and not on a noise signal. Thus, the first pulse is ignored and the second pulse is measured to determine the rise time. The selection of the time that Out1 remains high determines the length of the masking period. It can be programmed to be any range desired to block noise. In one embodiment, Out1 remains high for 10 ms, while in others it remains high for 5 ms or 30 ms.

In the alternative embodiment, the value of $R_7$ is varied in order to vary the time for masking out noise. If it is desired to mask out noise lasting in the range of 5 ms to 10 ms, then a larger resistor $R_7$ can be used in one embodiment. The larger resistor $R_7$ will slow the rate that node $N_1$ goes to ground and thus permits the circuit to filter out noise that is 5 ms, 10 ms, or 20 ms long, as desired by the end user.

In this alternative embodiment, Out1 will stay high until In1 goes low. The microcontroller will compare the incoming value of In1, and while it is low, keep Out1 high. When sufficient charge has bled off of $N_1$ to turn off transistor $T_2$, then In1 will go high based on the current from $I_2$ pulling it back high at a rate based on the value of $R_6$. By the time In1 is pulled high, node $N_1$ will be fully grounded. When In1 goes high again, this causes output Out1 to go low. The rise time on node $N_1$ is measured by sensing the time difference between Out1 going low and In1 going low. In this way, pulses shorter than a selected threshold can be filtered out and not counted. Full control of the threshold time can be selected by the person designing the circuit in which the chip is used. Thus in some embodiments, the masking time for noise is preset in the circuit as constructed, in other embodiments, it can be customer selected as the final circuit is constructed.

One benefit of the embodiment of the alternative system is that the value $R_7$ can be selected by the customer who is designing the product in which the circuit will be used. If one circumstance calls for a masking period of 1 ms, while another calls for a masking period of 10 ms, the chip user can easily achieve this by changing the value of $R_7$ as an external resistor to the circuit. All components, including transistor $T_1$-$T_3$ can be on chip and the resistor $R_7$ can be off chip, permitting the user to select the noise masking time as desired.

In the various embodiments, for pulses based on noise, such as from static electricity or other noise, there will be no conduction between bars 16 and 17 at time $t_4$ when the sensing begins again, so no rise time will be measured for noise created signals.

Figure 8:
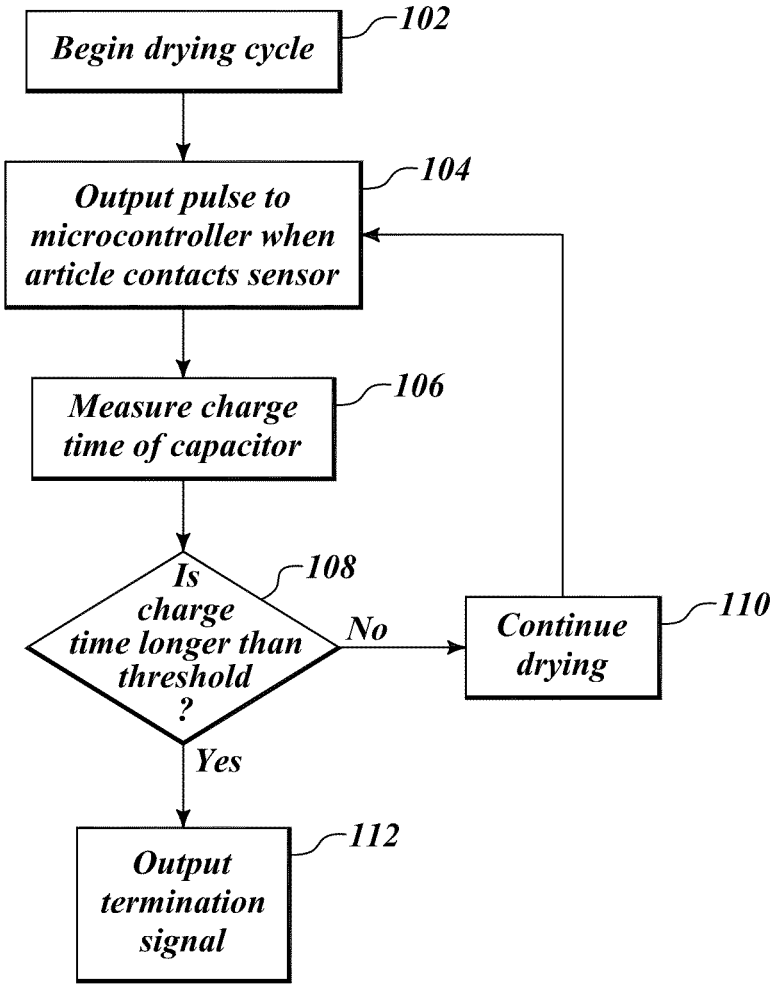
FIG. 8 is a flow chart diagram of a method for determining dryness of clothes according to one embodiment.

FIG. 8 is a flow diagram of a method according to one embodiment. At 102, wet clothes or other articles are placed in the bin 12 of a dryer 10 and a drying cycle is begun. As the clothes or other articles tumble in the dryer 10, the clothes or other articles come into contact with the sensor 15 in the dryer bin 12. At 104 a pulse is output when the capacitor $C_1$ charges to the threshold voltage. At 106 the charge time of the capacitor is measured. At 108 the charge time is compared to a threshold time. If the charge time is shorter than the threshold time, then the dryer 10 continues to dry the clothes at 110. If the charge time is longer than the threshold time, then microcontroller 22 outputs a termination signal and the dryer cycle ends. Alternatively, the microcontroller 22 may issue the termination signal based on a plurality of charge times rather than a single charge time.

Figure 9:
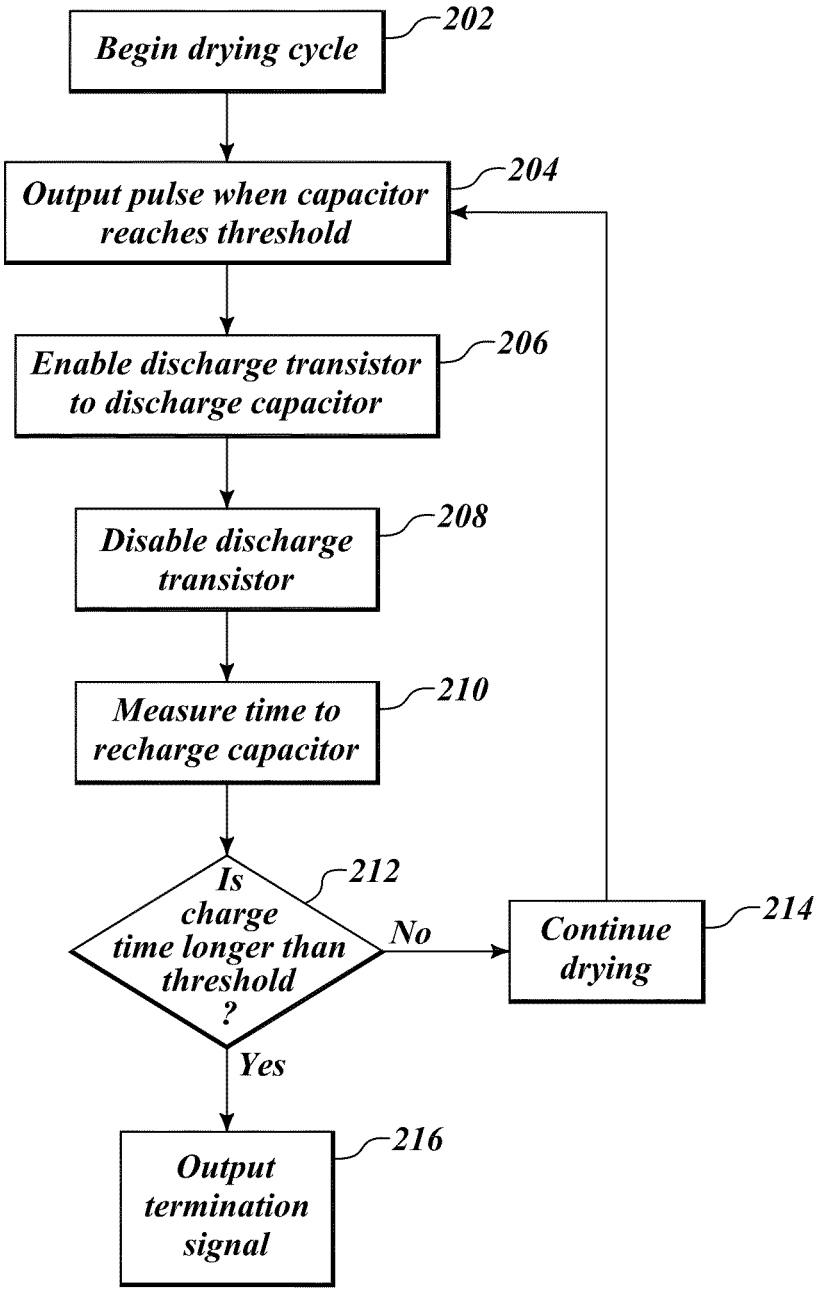
FIG. 9 is a flow chart diagram of a method for determining dryness of clothes according to an alternative embodiment.

FIG. 9 is a flow diagram of a method according to an alternative embodiment. At 202, wet clothes or other articles are placed in the bin 12 of a dryer 10 and a drying cycle is begun. As the clothes or other articles tumble in the dryer 10, the clothes or other articles come into contact with the sensor 15 in the dryer bin 12. At 204 a pulse is output when the capacitor $C_1$ charges to the threshold voltage. At 206, a discharge transistor $T_3$ is enabled to rapidly discharge the capacitor $C_1$. At 208 the discharge transistor $T_3$ is disabled. At 210, the capacitor recharges to the threshold voltage and the recharge time is measured by the microcontroller. At 212 the charge time is compared to a threshold charge time. If the charge time is shorter than the threshold then the drying cycle continues at 214. If the charge time is longer than the threshold then the microcontroller issues a termination signal to end the drying cycle at 216. alternatively, the microcontroller 22 may issue the termination signal based on a plurality of charge times rather than a single charge time.

Of course, this circuit may also be applied to mask noise signals in other circuits, such as in cameras, scanners, voltage regulators, cell phones or other environments in which short noise pulses may be interpreted as real signal pulses. The short noise pulses can be blocked by this masking and only the real signals considered for further evaluation.

In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A dryer, comprising:

a bin for drying clothes;

a moisture sensor in the bin;

a capacitor coupled to the moisture sensor and configured to charge when the clothes contact the sensor;

a first switch coupled to the capacitor and configured to generate a pulse when a voltage of the capacitor reaches a threshold voltage; and a microcontroller coupled to the first switch and configured to receive the pulse, to calculate a charge time of the capacitor, and to output a termination signal when the charge time exceeds a threshold value.

2. The dryer of claim 1, comprising a second switch coupled to the capacitor and configured to discharge the capacitor on a leading edge of the pulse.

3. The dryer of claim 2 wherein the charge time is measured from a discharge of the capacitor by the second switch to a generation of a subsequent pulse.

4. The dryer of claim 1 wherein the microcontroller measures a plurality of charge times and generates the termination signal based on the plurality of charge times.

5. The dryer of claim 1 wherein the charge time is indicative of a moisture content of the clothes.

6. The dryer of claim 1 wherein the sensor comprises a first conductor and a second conductor.

7. The dryer of claim 1 wherein the microcontroller is configured to issue the termination signal when the charge time of the capacitor is longer than a threshold length of time.

* * * * *